US008218795B2

(12) United States Patent
Tripp et al.

(10) Patent No.: US 8,218,795 B2
(45) Date of Patent: Jul. 10, 2012

(54) METHODS FOR FORMING AND USING THIN FILM RIBBON MICROPHONE ELEMENTS AND THE LIKE

(75) Inventors: Hugh A. Tripp, Mansfield, MA (US); Robert J. Crowley, Sudbury, MA (US)

(73) Assignee: Shure Incorporated, Niles, IL (US)

( * ) Notice: Subject to any disclaimer, the term of this patent is extended or adjusted under 35 U.S.C. 154(b) by 1324 days.

(21) Appl. No.: 11/725,137

(22) Filed: Mar. 16, 2007

(65) Prior Publication Data

US 2007/0223773 A1 Sep. 27, 2007

Related U.S. Application Data

(63) Continuation-in-part of application No. 11/242,611, filed on Oct. 3, 2005, now Pat. No. 7,894,619, and a continuation-in-part of application No. 11/242,612, filed on Oct. 3, 2005, now Pat. No. 7,900,337.

(60) Provisional application No. 60/620,934, filed on Oct. 21, 2004.

(51) Int. Cl.
*H04R 25/00* (2006.01)
*H04R 1/00* (2006.01)
*G10K 13/00* (2006.01)

(52) U.S. Cl. ..... 381/176; 381/399; 181/164

(58) Field of Classification Search ..... 381/176, 381/423, 425, 431, 399; 181/164; 29/594
See application file for complete search history.

(56) References Cited

U.S. PATENT DOCUMENTS 1,885,001 A 10/1932 Olson
1,892,645 A 12/1932 Olson et al.
2,173,219 A 9/1939 Anderson
2,230,104 A 1/1941 Bostwick
2,305,599 A 12/1942 Bauer
2,361,656 A 10/1944 Rogers
2,527,344 A 10/1950 Anderson
2,699,474 A 12/1950 Olson et al.
2,539,671 A 1/1951 Olson
2,673,251 A 3/1954 Duncan (Continued)

FOREIGN PATENT DOCUMENTS

EP 1318706 7/2001

(Continued)

OTHER PUBLICATIONS

Harry F. Olsen, Ribbon Velocity Microphones, Journal of the Audio Engineering Society, Jun. 1970, vol. 18, No. 3.

(Continued)

*Primary Examiner* — Curtis Kuntz
*Assistant Examiner* — Sunita Joshi
(74) *Attorney, Agent, or Firm* — Banner & Witcoff, Ltd.

(57) ABSTRACT

A geometrically shaped acoustic polymer ribbon with shape memory, high conductivity, high toughness. A method of manufacturing the ribbon comprises: forming a sized, elongated, coated or coatable polymeric substrate film between a pair of opposed, geometrically shaped dies, pinching the dies about the polymeric substrate film to form an assembly, heating the dies and the pinched die and polymeric film assembly to a temperature of at about 300 degrees F. for a period of about 15 minutes to set the elongated film into a predetermined geometric pattern, cooling the assembly, removing the film from the dies; and if not already coated, coating the geometrically formed, set, elongated film with a conductive coating.

38 Claims, 11 Drawing Sheets

U.S. PATENT DOCUMENTS

| | | | | |
|---|---|---|---|---|
| 2,963,557 | A | 12/1960 | Anderson | |
| 3,435,143 | A | 3/1969 | Fisher | |
| 3,564,163 | A * | 2/1971 | Hobrough | 381/399 |
| 3,619,517 | A | 11/1971 | Bleazey | |
| 3,832,499 | A * | 8/1974 | Heil | 381/408 |
| 4,001,523 | A | 1/1977 | Kasatkin et al. | |
| 4,281,223 | A | 7/1981 | Ugaji et al. | |
| 4,319,096 | A | 3/1982 | Winey | |
| 4,384,173 | A * | 5/1983 | Briefer et al. | 381/431 |
| 4,395,592 | A | 7/1983 | Colangelo | |
| 4,406,059 | A | 9/1983 | Scott et al. | |
| 4,413,160 | A | 11/1983 | Ohyaba et al. | |
| 4,460,060 | A | 7/1984 | Hasumi et al. | |
| 4,473,723 | A | 9/1984 | Hobrough | |
| 4,484,037 | A | 11/1984 | Nieuwendijk et al. | |
| 4,517,416 | A | 5/1985 | Goossens | |
| 4,580,014 | A | 4/1986 | Hobrough | |
| 4,809,578 | A | 3/1989 | Lace | |
| 5,021,613 | A | 6/1991 | Garcia | |
| 5,195,143 | A | 3/1993 | Spiegel | |
| 5,212,736 | A | 5/1993 | Tsukagoshi | |
| 5,701,359 | A | 12/1997 | Guenther | |
| 5,982,905 | A | 11/1999 | Grodinsky | |
| 6,137,891 | A | 10/2000 | Porrazzo et al. | |
| 6,285,769 | B1 | 9/2001 | Edelson | |
| 6,393,129 | B1 | 5/2002 | Conrad | |
| 6,434,252 | B1 | 8/2002 | Royer | |
| 6,535,612 | B1 | 3/2003 | Croft | |
| 6,834,113 | B1 | 12/2004 | Liljehag | |
| 6,868,166 | B1 | 3/2005 | Zhang | |
| 6,925,191 | B2 | 8/2005 | Petroff et al. | |
| 6,956,953 | B2 | 10/2005 | Mazarakis | |
| 7,058,195 | B2 | 6/2006 | Trandafir | |
| 7,106,880 | B2 | 9/2006 | Bengtsson | |
| 7,116,796 | B1 | 10/2006 | Reenberg | |
| 7,149,321 | B2 | 12/2006 | Hutt | |
| 7,203,332 | B2 | 4/2007 | Hutt | |
| 7,278,200 | B2 | 10/2007 | Steere | |
| 7,302,748 | B2 | 12/2007 | Jiles | |
| 7,430,297 | B2 | 9/2008 | Akino | |
| 7,894,619 | B2 | 2/2011 | Crowley | |
| 7,900,337 | B2 | 3/2011 | Crowley | |
| 2002/0080991 | A1 | 6/2002 | Bengtsson | |
| 2002/0094108 | A1 * | 7/2002 | Yanagawa et al. | 381/423 |
| 2003/0016116 | A1 | 1/2003 | Blaha | |
| 2005/0100181 | A1 | 5/2005 | Croft | |
| 2005/0244016 | A1 | 11/2005 | Norris | |
| 2006/0078135 | A1 | 4/2006 | Royer | |
| 2006/0078152 | A1 | 4/2006 | Royer | |
| 2007/0014427 | A1 | 1/2007 | Schafer | |
| 2007/0047756 | A1 | 3/2007 | Jiles | |
| 2008/0130939 | A1 | 6/2008 | Jiles | |
| 2008/0273739 | A1 | 11/2008 | Short | |

FOREIGN PATENT DOCUMENTS

| | | |
|---|---|---|
| JP | 4878921 | 10/1973 |
| JP | 50106616 | 9/1975 |
| JP | 56158869 | 11/1981 |
| JP | 57155373 | 9/1982 |
| JP | 5068519 | 3/1993 |
| JP | 5140337 | 6/1993 |
| JP | 5189411 | 7/1993 |
| JP | 5216803 | 8/1993 |
| WO | 99/55118 | 10/1999 |
| WO | 9955118 | 10/1999 |

OTHER PUBLICATIONS

Graham Bank, M.O.J. Hawksford, Comparison between the Measured and Computed Performance of Ribbon Loudspeakers, Presented at the 100th convention of the Audio Engineering Society Copenhagen, May 1996, Preprint 4210(J-7).

Office Action dated Feb. 9, 2009 for U.S. Appl. No. 11/242,611, 11 pages.

Office Action dated Jun. 19, 2009 for U.S. Appl. No. 11/242,611, 25 pages.

Office Action dated Dec. 17, 2009 for U.S. Appl. No. 11/242,611, 29 pages.

Office Action dated Jun. 16, 2010 for U.S. Appl. No. 11/242,611, 30 pages.

Office Action dated Feb. 9, 2009 for U.S. Appl. No. 11/242,612, 9 pages.

Office Action dated Aug. 18, 2009 for U.S. Appl. No. 11/242,612, 46 pages.

Office Action dated Mar. 10, 2010 for U.S. Appl. No. 11/242,612, 15 pages.

International Search Report for PCT/US2005/35702, dated Nov. 27, 2006.

Shorter, D.E.L., Hardwood, H.D., The Design of a Ribbon Type Pressure-Gradient Microphone for Broadcast Transmission, British Broadcasting Corporation, Monograph No. 4, Dec. 1955, pp. 5-22.

Ericson, Lars M., et al., Macroscopic, Neat, Single-Walled Carbon Nanotube Fibers, Science, vol. 305, Sep. 3, 2004, pp. 1447-1450.

* cited by examiner

STATIC STATE

FORCE APPLIED

RETURN TO STATIC

Comparison of characteristics of ribbon microphone vs. ribbon tweeter Figure 16

| | Frequency Response | Power | Thickness | Sensitivity | Mass | Excursion | Toughness | Can it be damaged by phantom power |
|---|---|---|---|---|---|---|---|---|
| Ribbon Tweeter | Upper only | High | Thick | Low | High | Low | Yes | No |
| Ribbon Microphone with thin film acoustic ribbon | Entire Band | Low | Thin | High | Low | High | Yes | No |
| Ribbon Microphone Prior Art | Entire Band | Low | Thin | High | Low | Low | No | Yes |

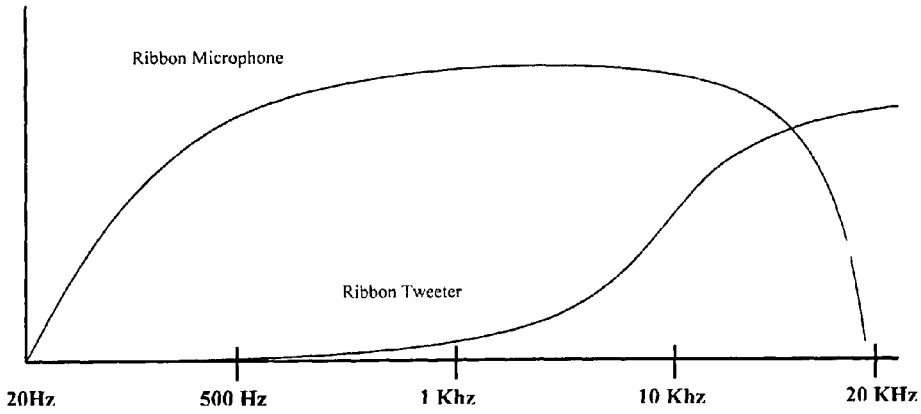

Frequency Range Ribbon Microphone vs. Ribbon tweeter Figure 17

METHODS FOR FORMING AND USING THIN FILM RIBBON MICROPHONE ELEMENTS AND THE LIKE

One embodiment of the present invention relates to microphone elements which are responsive to minute acoustic vibration of fluids such as air over the frequency and amplitude range of human hearing, yet which are tough and resistant to various damaging forces, and a method for manufacturing thin film acoustic ribbons particularly for ribbon microphones, and is a continuation-in-part of our U.S. patent application Ser. No. 11/242,611 filed Oct. 3, 2005 now U.S. Pat. No. 7,894,619 and Ser. No. 11/242,612 filed Oct. 3, 2005, now U.S. Pat. No. 7,900,337 which were based on Provisional patent application Ser. No. 60/620,934 filled 21 Oct. 2004, each of which are incorporated herein by reference in their entirety.

FIELD OF THE INVENTION

One aspect of the present invention to provides an arrangement for producing an improved material that may be used as acoustic ribbons that overcome the disadvantages of the prior art.

Another aspect of the present invention provides polymer acoustic ribbons that have minimum mass and high sensitivity and with high signal conductivity coatings thereon.

Another aspect of the present invention provides polymer ribbon articles that may retain a geometric shape after being distorted.

In another aspect of the invention the sound sensor is usable as a wide bandwidth microphone having a frequency response approximately corresponding to that of the entire range of the human ear.

BRIEF SUMMARY

One embodiment of the present invention comprises a low mass, high conductivity, shape memory acoustic film material and a process utilized for the forming of an arrangement of polymer film acoustic ribbons, and the like, which ribbons are to be used in acoustic transducers including for example, ribbon microphones as fluid responsive moving sound sensors.

Another embodiment of the present invention comprises the method of designing and using such an arrangement to produce a fluid responsive sound sensor having particular mechanical, electrical and shape-memory characteristics that result in a durable yet light and low mass, highly sensitive fluid responsive sound sensor.

DISCUSSION OF THE PROCESSES AND APPLICATIONS

The processes of designing and fabricating practical ribbon structures begin with selecting a candidate material for fabricating sound responsive structures which may be, for example, a thin-film polyethylene terephthalate, or PET. The PET material may be supplied in roll or sheet form. The size selected may be about 3 inches wide, and the thickness selected may be about 2.5 microns, which is very thin, and light. PET is a high strength polymeric material that, during or after the foil ribbon manufacturing process, may be prepared with a layer of aluminum, gold, or other conductive metallic material as will be further taught herein.

Before the forming process can begin the polymer material must be cut into the desired shape. For a ribbon microphone application, where typically an elongated sound sensor is suspended between the poles of parallel magnets, the polymer material may be cut into rectangular strips. The preferred cutting method includes the use of a precision blade shear or a laser cutter. During the blade shearing process, the thin film polymer material may stick to the shear blade due to a static charge therewith. The polymer film also has a tendency to push away during the shearing process leaving the cut strip slightly tapered. To solve these problems, the material may be held for example, between two layers of waxed paper and adhesively taped along its leading edge with masking tape. This arrangement provides a static barrier and adds a temporary mass and rigidity to the polymer film, virtually eliminating the tendency for it to be pushed away during the shearing process.

Once the material is cut into the desired shape, in this example, a rectangle, a forming process may then be performed. The material may be thermally formed, or set, into the desired shape by placing the material between a pair of shaped steel dies, or forming dies. An identical repeating zig-zag or sawtooth pattern, for example, on the forming dies allows the two sides of the dies to mesh together with the material to be formed in between. With the two halves of the forming dies securing the material therebetween, the arrangement is ready to be thermally set.

A convenient method for heating the forming die assembly and polymer material is to place the articles, in a meshed state, into a preheated oven that is controlled by a thermostat. The forming die and polymer are then subjected to a suitable temperature over a period of time, and then removed from the oven and allowed to cool, when the polymer material will be found to have assumed the shape of the forming dies.

The material may be tested to determine its linear tensile strength and demonstrate that the PET material is about 8 times stronger than the thin aluminum material commonly used for ribbon microphone applications.

The material tensile, elongation and shape memory properties are important to the longevity and performance of acoustic ribbon elements. Because of the high strength, a polymeric ribbon element such as that made as taught herein is very desirable. This material when used as a ribbon element has the ability to resist wind blasts, high sound pressure levels, and electrical jolts such as those caused by the application of phantom power, without breaking or sagging. Phantom power is the 48 volt DC power supplied by mixing boards and microphone amplifiers used to power condenser type microphones. In some instances, the 48 volt DC power can be unintentionally routed to the ribbon microphone, which can then permanently distort and ruin the ribbon.

The excellent shape memory of preformed ribbons made from polyethylene terephthalate and other polymer and composite substrates allows them to retain their geometry and they can be extended to the point where the corrugations are flattened and readily returned, unstrained, to the original corrugated state. This material also has high strength which means the thickness of the material can be decreased to about 1.5 microns or less, thereby reducing the mass of the ribbon element which is also desirable because a lower mass ribbon is more responsive to incoming sound waves. Lower substrate and ribbon mass results in greater sensitivity and is desirable as it allows the faintest sounds to be converted into electrical energy. Having a low "substrate mass" may also be desirable in some instances where other high conductivity coatings with relatively greater mass than aluminum, such as gold and gold alloys for example, are used therewith.

Aluminization using direct evaporation of aluminum atoms upon the thin substrate material, applied evenly to one or both sides, has been found effective to produce a desired structure that is tough yet relatively low in mass, highly flexible and with good shape memory, and highly conductive, all of which are required for the successful sound-responsive ribbon-type element that may be used in a ribbon microphone or the like.

One embodiment of the invention comprises a ribbon microphone that accommodates the entire range of human hearing, both in frequency response and also in dynamic range including high sound pressure levels exceeding safe hearing limits but within recordable limits using the improved microphone and ribbon assembly. Such sound pressure levels start below about 10 dB, which is at the lowest threshold of natural hearing, and extend to above 150 dB, which is well above a safe sound level for humans, but within normal operating range of the ribbon microphone assembly as taught herein.

Another aspect of the invention includes a fluid coupled sound sensor having a corrugated ribbon-like form comprised of layers of conductive and nonconductive materials, the nonconductive materials having a thickness of about 3 microns or less and the conductive coating having a thickness of at least 100 nanometers, with a total weight of about 0.004 grams per square inch or less. The structure is produced whereby the conductive and nonconductive materials work in unison to produce a highly flexible, shape memory, highly sound responsive component, and whereby said sound responsive component comprises the ribbon in a ribbon microphone assembly having an acoustic responsivity of about 2 Hz to about 20 KHz.

Further, the ribbon structure is effective to return to a corrugated shape after extension to a flat shape, as encountered during wind blasts, for example, thereby overcoming limitations in the prior art, while maintaining sensitive sound responsivity over the acoustic range of human hearing.

One embodiment of the invention thus comprises a fluid coupled sound-sensor having a corrugated ribbon-like form comprised of layers of conductive and nonconductive materials, the nonconductive materials having a thickness of about 3 microns or less and the conductive layer having a thickness of at least 100 nanometers, with a total weight of about 0.004 grams per square inch or less, whereby the conductive and nonconductive materials work in unison to produce a highly flexible, shape memory, sound-responsive component, and whereby the sound responsive component comprises a ribbon in a ribbon microphone assembly having an acoustic responsivity of about 20 Hz to about 20 KHz. The conductive layer may be comprised of aluminum. The non-conductive layer may be comprised of a polymer. The corrugated ribbon-like form is cyclable from said corrugated form to a flat form and back to a corrugated form.

Another embodiment of the invention comprises a geometrically shaped acoustic ribbon comprised of layers with one layer being a highly elastic shape memory material and at least one additional layer of highly conductive material, wherein the combination of the layers produces high elongation and toughness characteristics while maintaining low mass and high conductivity of said acoustic ribbon.

Another embodiment of the invention comprises a method of manufacturing a coated, geometrically shaped, shape memory acoustic ribbon with an elastic polymeric substrate material with a second highly conductive layer and weighing no more than 0.004 grams per square inch and comprising: forming a sized, elongated, coated or coat-able polymeric substrate film between a pair of opposed, geometrically shaped dies; pinching the dies about the polymeric substrate film to form an assembly; heating said dies and said pinched die and polymeric film assembly to a temperature of about 300 degrees F. for a period of about 15 minutes to set said elongated film into a predetermined geometric pattern; cooling the assembly; removing the film from the dies; and if not pre-coated with a conductive coating, coating the geometrically formed, set, elongated film with a conductive coating. The polymeric film may be comprised of polyethylene terephthalate. The coating may be comprised of a metal selected from the group comprises of: aluminum, gold, silver, nitinol, copper-zinc-aluminum and copper-aluminum-nickel. The method may include perforating the polymeric film with a plurality of spaced apart holes to minimize the mass thereof. The method may include applying a coating of wetting material to the film prior to the pinching of the film between the dies. The wetting material may be comprised of isopropyl alcohol.

Another embodiment of the invention includes an acoustic ribbon for use in a flux frame of an acoustic ribbon microphone, comprising: an elongated polymeric substrate coated with a conductive coating; an arrangement of holes spaced along the substrate through the conductive coating and the substrate. The conductive coating may be comprised of nickel titanium. The conductive coating may be comprised of a compound selected from the group comprised of aluminum, copper, zinc or nickel. The elongated polymeric substrate may be comprised of a zig-zag geometric shape.

Another embodiment of the invention includes an elongated acoustic ribbon for microphones, the ribbon being comprised of a polymer substrate and a first conductive layer of metal coated on a first side of the substrate, the acoustic ribbon having a total weight no greater than 0.004 grams per square inch. The substrate may consist of Polyethylene Terephthalate. The substrate may be coated by a second conductive layer of metal on a second side thereof. The elongated acoustic ribbon for microphones may reside unstrained, in a zig-zag shape in cross section. The elongated acoustic ribbon may be comprised of a "shape-memory" microphone element. The second conductive layer of metal may be comprised of metal of a different thickness than the first conductive layer. The second conductive layer of metal may be comprised of a different conductive metal than the first conductive layer.

Another embodiment of the invention comprises an elongated shape memory acoustic microphone ribbon element assembly, consisting of: an elongated shape memory polymeric substrate; and a conductive coating arranged on the substrate, wherein the ribbon element assembly weighs no more than 0.004 grams per square inch. The conductive coating may comprise carbon nanotubes. The substrate may have a predetermined shaped formed thereon. The coating may be arranged on both a first and a second side of the substrate. The substrate may be comprised of Polyethylene Terephthalate. The coating may be comprised of a metal. The coating may be comprised of aluminum. The assembly preferably has dimensions of about: length 3.4" and 0.145" wide and 2.5 microns thick, and weighs about 0.002 grams. The substrate may be perforated. The coating may be perforated.

BRIEF DESCRIPTION OF THE DRAWINGS

The objects and advantages of the present invention will become more apparent when viewed in conjunction with the following drawings in which:

FIG. 16 is a table of ribbon characteristics; and

FIG. 17 is a graph of ribbon frequency ranges.

DETAILED DESCRIPTION OF THE PREFERRED EMBODIMENTS

Figure 1:
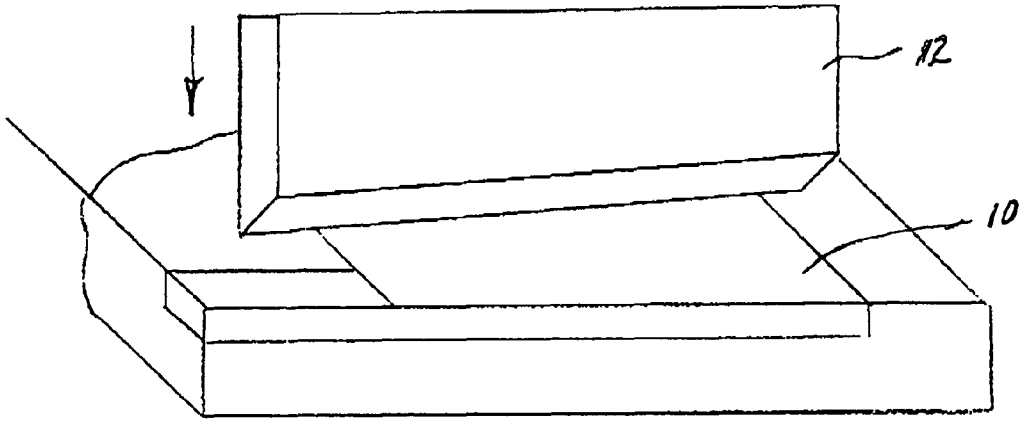
FIG. 1 is a perspective graphic showing a set of blades of a shear used to cut very thin foils in the construction of the present invention.

Referring now to the drawings in detail, and particularly to FIG. 1, there is shown an initial step in the process of the present invention, for the forming of polymer foil acoustic ribbons, which ribbons are to be used in acoustic transducers including for example, ribbon microphones.

The process begins with the selection of a suitable polymeric material, for example, a thin film polyethylene terephthalate 10. This material is supplied in roll and sheet form and the material size selected is 3 inches wide and the thickness is 2.5 microns. This polymeric material is, during or after the foil ribbon manufacturing process, coated with a layer of aluminum, gold, or other conductive material.

Before the forming process can begin the polymer material 10 must be cut into the desired shape as represented in FIG. 1. For a ribbon microphone application, the polymer material is cut into rectangular strips that are for example, about 3 inches long by about 0.145 inches wide. The preferred cutting method includes the use of a precision shear 12. During the shearing process the thin film polymer material may stick to the shear 12 because of a static charge therewith. The polymer film 10 also has a tendency to push away during the shearing process leaving the cut strip slightly tapered.

Figure 2:
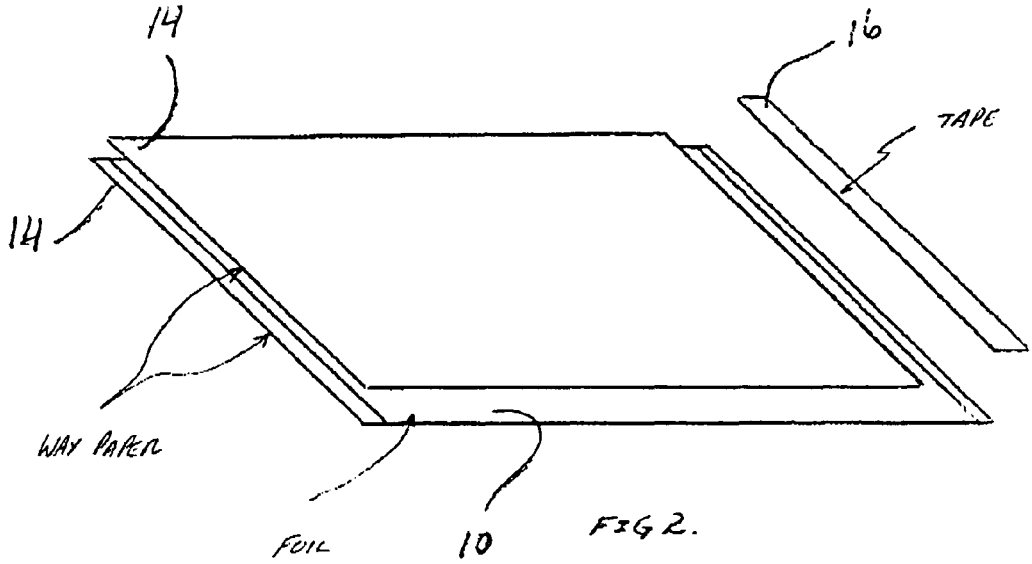
FIG. 2 is a perspective view showing a foil and wax paper sandwich taped together in preparation for cutting with a shear.

Referring to FIG. 2 the polymer film 10 is sandwiched between two layers of waxed paper 14 and taping along its leading edge with masking tape 16. This provides a static barrier and adds a temporary mass and rigidity to the polymer film 10 and eliminates the shearing problems of static and push away as described above.

Figure 3:
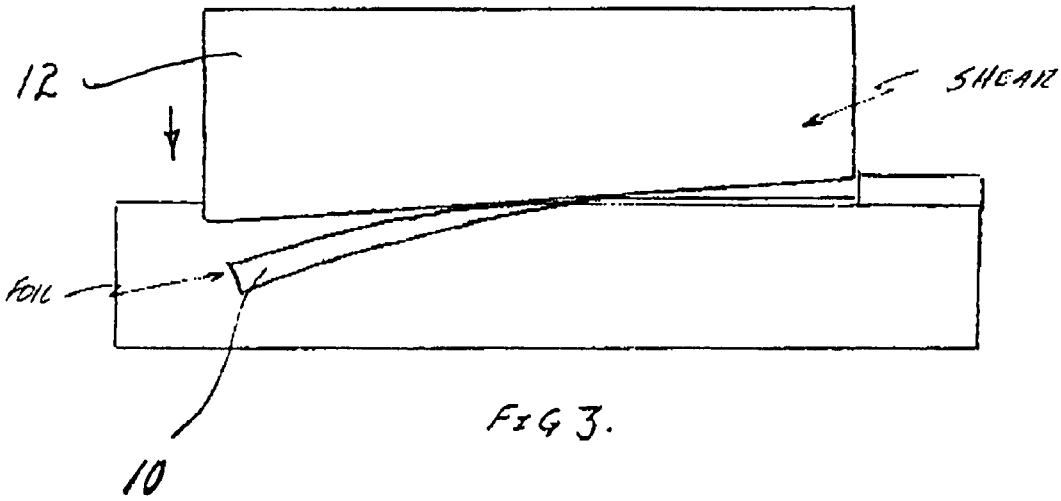
FIG. 3 is a side view of a strip of foil being sheared.

Referring to FIG. 3 the foil 10 is being sliced into a rectangular strip such as those used in microphone applications by the shear 12 which is also shown in FIG. 1.

Figure 4:
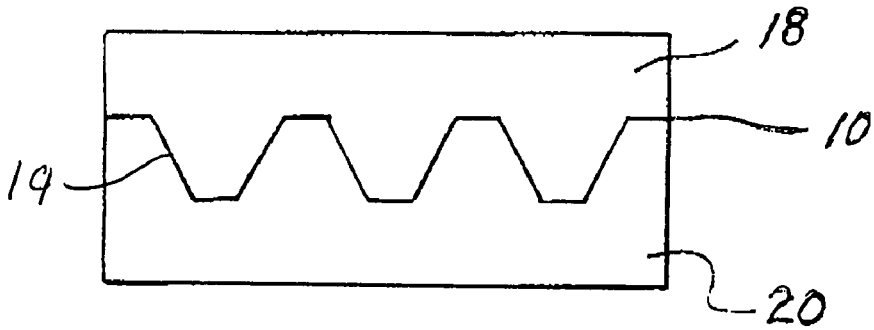
FIG. 4 is a side view of a forming die.

Referring to FIG. 4 the sliced rectangular polyethylene terephthalate film 10 is heat set into the desired shape by a sandwiching arrangement between a pair of steel dies 18 and 20. An identical zig-zag shaped repeating pattern 19 allows the two sides of the dies 18 and 20 to mesh together.

Figure 5:
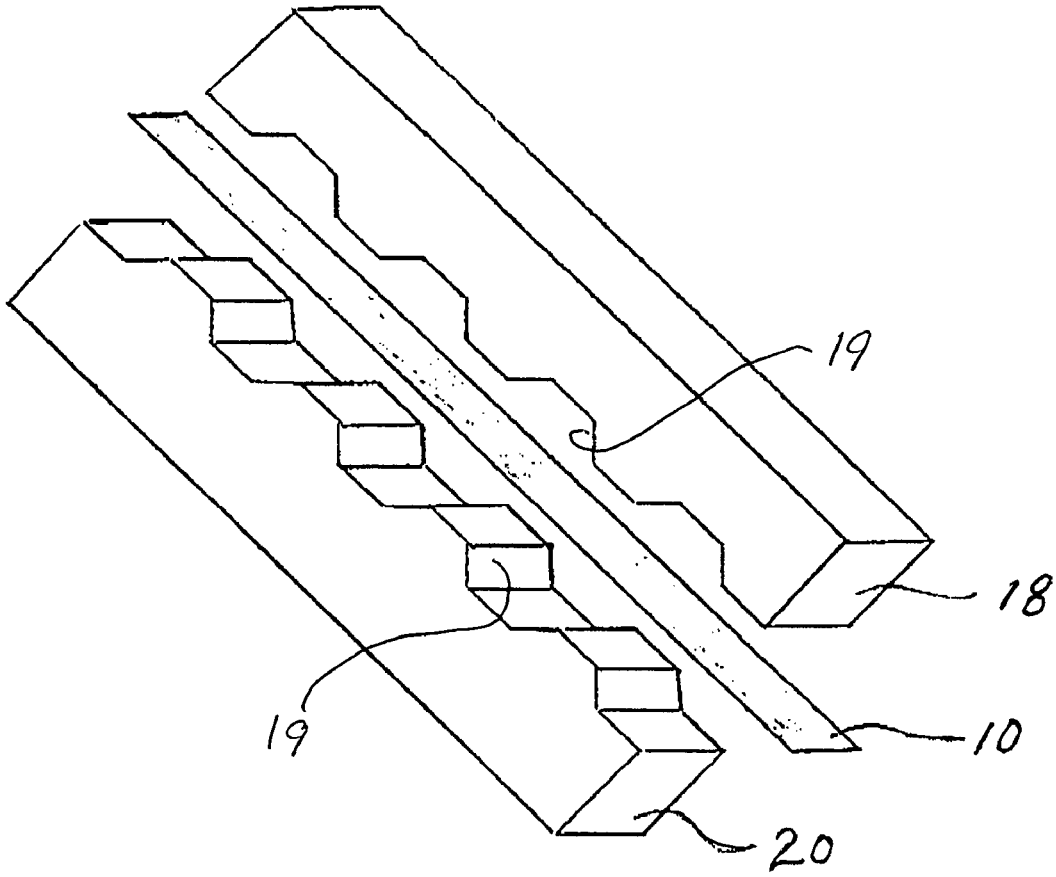
FIG. 5 is a perspective graphic of the two halves of a forming die set, with a strip of foil arranged therebetween.

Referring to FIG. 5 the sliced rectangular polyethylene terephthalate film 10 is shown between the forming dies 18 and 20 before the dies are meshed together. There are two methods used for placing the film material 10 between the dies 18 and 20. One method is to lay the material flat between the one face of the die 20 and place the other half of the die 18 on top of the film material 10, also represented in FIG. 5, in a way that allows the two dies to mesh with one another. A light pressure is applied to the two dies 18 and 20 until they are firmly meshed together with the film material 10 in between.

Figure 6:
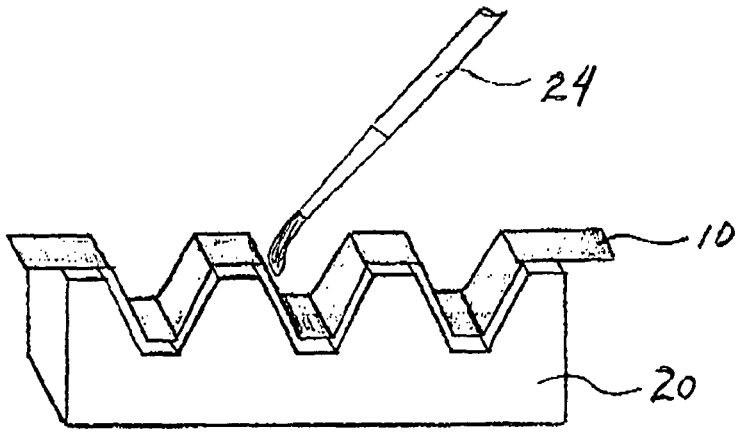
FIG. 6 is a perspective view of foil being wetted with a fluid such as alcohol and brushed into an array of groove portions of the forming die.

The second method for placement of the film material 10 between the dies 18 and 20 is represented in FIG. 6, wherein the film material 10 is lain onto the first die 20 and using for example, a wetting agent such as isopropyl alcohol to wet the film material 10 with a small paint brush 24 or spraying or the like, and push the film material 10 into the die 20 so the capillary action between the ribbon film material 10 and the die 20 helps the film material 10 to follow the shaped geometry of the die 20. When the film material 10 is in place, the second die 18 is placed thereon and pressure is applied thereto.

Figure 7:
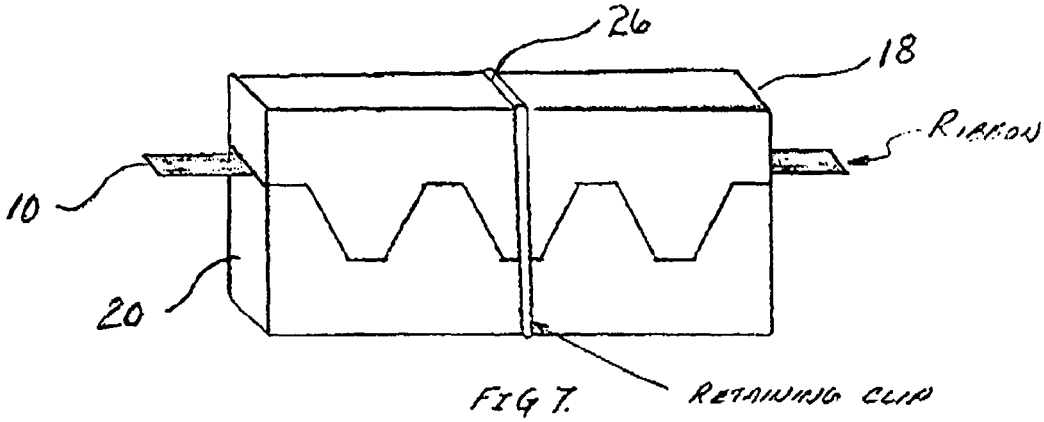
FIG. 7 is a perspective graphic of a clamped forming die assembled with a strip of foil in place, indicating its position in the oven.

Referring to FIG. 7 the dies 18 and 20 may be held in place sandwichingly around the film material 10 by use of a clip or wire means 26 bindingly wrapped theraround. With the two halves of the forming dies 18 and 20 securing the film material 10 therebetween, the film 10 is ready to be heat set. The preferred method for heating the forming die assembly (10, 18, 20 and 26) is for heat setting in an oven, (not shown for clarity of views). The temperature of the oven is set and may be monitored using a thermocouple. The oven may be preheated for 30 minutes and the temperature may be set for example, at about 300° F. The fluctuation in the oven set at 300° F. is recorded at about 295° F.-305° F. A flat tray is preferably placed in the oven when it is turned on and allowed to preheat with the oven. When the oven preheat is completed the forming die assembly (10, 18, 20 and 26) is placed in the oven on the tray in an upright position. The amount of time required for the film material 10 to permanently take the geometric shape of the dies 18 and 20 is for example, about 15 minutes. After opening the oven door the temperature drops and the oven must come back up to temperature before starting the timer. When the heat cycle is complete the dies 18 and 20 are removed from the oven and allowed to cool for about 10 minutes before the dies 18 and 20 are opened and the film material 10 removed therefrom.

Figure 8:
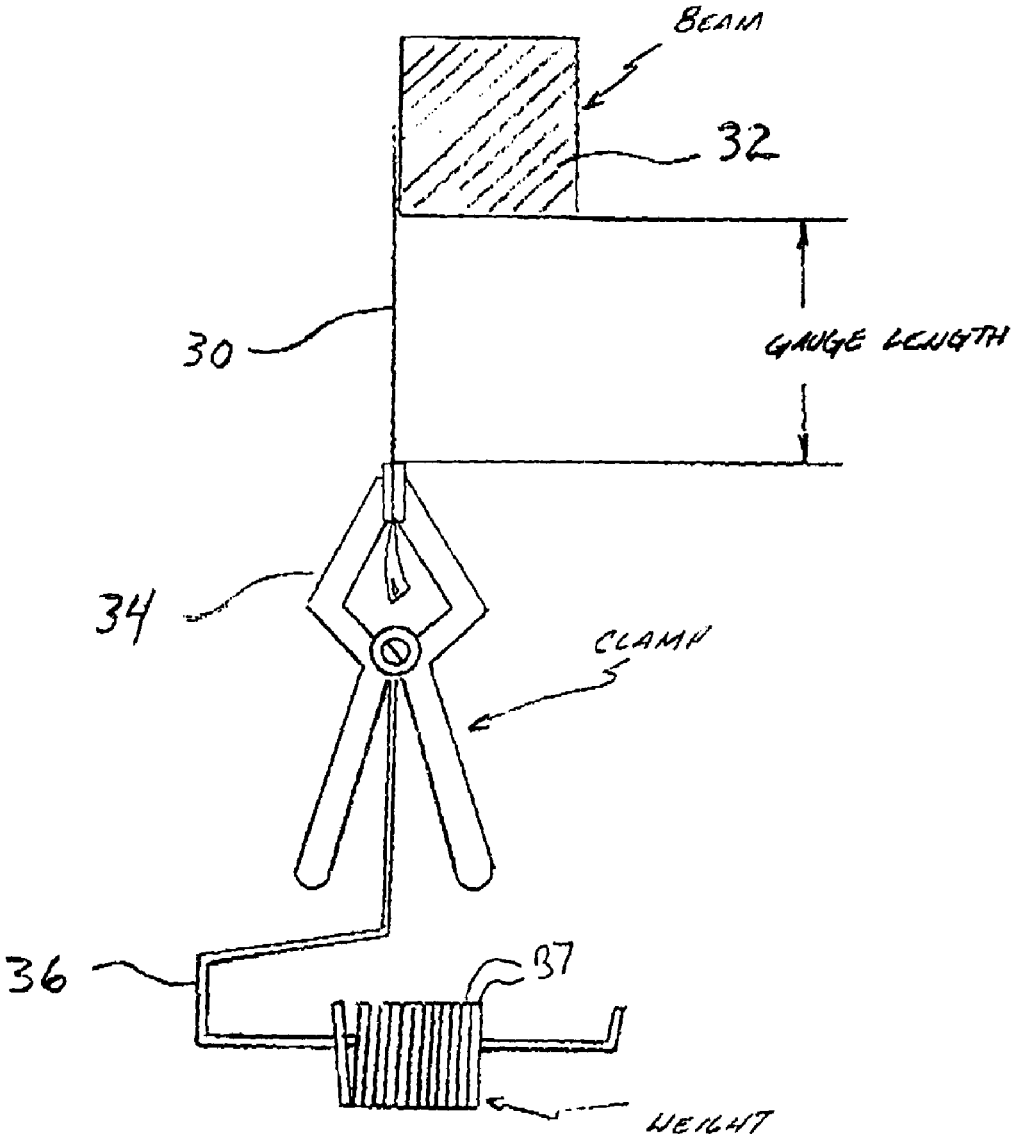
FIG. 8 is a side view of a tensile set up using a hanging weight method with a specified gauge length.

Referring to FIG. 8 the film material 10 may be tested to determine its linear tensile strength. There are a number of ways this can be achieved including the use of a commercial tensile tester, for example an Instron™ tensile device, or by use of a hanging weight method. Samples of polyethylene terephthalate film 30 were tested using the hanging weight method. The dimensions were about 3 inches long 0.157 inches wide and 2.5 microns thick. The polyethylene terephthalate film sample 30 was suspended from a beam 32 using adhesive tape to secure it to that beam 32. The modified clamp 34 with a weight hanger 36 was attached to the opposite end of the polyethylene terephthalate 30. The space between the beam 32 and the distal end of the jaws of the clamp 34 (gauge length) which in this example, was 1.5 inches. Weights 37 were gradually added to the weight hanger 36 until failure of the polyethylene terephthalate 30. The polyethylene terephthalate 30 failed after a total of about 139 grams of weight were added to the hanger 36. The polyethylene terephthalate 30 elongated about 0.5 inches total, most of this occurring after the last 20 grams of weight were added. As a comparison a sample of aluminum was tested using the same method. The aluminum was the same size as the polyethylene terephthalate film and the same gauge length was used. The aluminum failed after the addition of about 16.7 grams of weight with no noticeable elongation. Therefore the polyethylene terephthalate film is about 8 times stronger than the aluminum material commonly used for ribbon microphone applications.

Figure 9A:
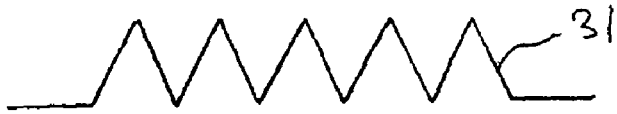
FIG. 9A is a side view of an acoustic ribbon shown formed in a corrugated shape.
Figure 9B:
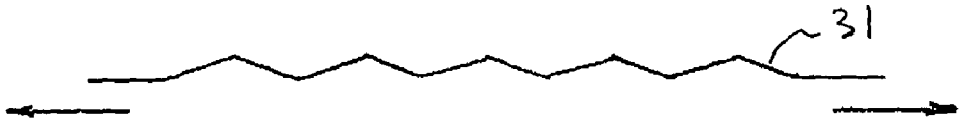
FIG. 9B is a side view of an acoustic ribbon deformed into an almost flat shape.
Figure 9C:
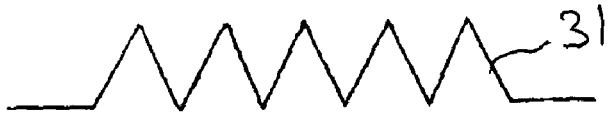
FIG. 9C is a side view of an acoustic ribbon shown having returning to its original formed corrugated geometric shape.

Referring to FIG. 9A the excellent shape memory of preformed ribbons 31 made for example, from polyethylene terephthalate 30 and other polymer substrates, allows them to retain their geometry and can be extended to the point where the corrugations are flattened, as represented in FIG. 9B, and then readily return, unstrained, to a preset corrugated state as represented in FIG. 9C. Having high strength also means the thickness of the material can be decreased to about 1.5 microns or less, thereby reducing the mass of the ribbon element which is also desirable because a lower mass ribbon is more responsive to incoming sound waves. This will result in greater sensitivity and permit in some applications the use of high conductivity coatings with greater mass, such as for example gold, which has poor tensile strength when used alone.

Figure 10A:
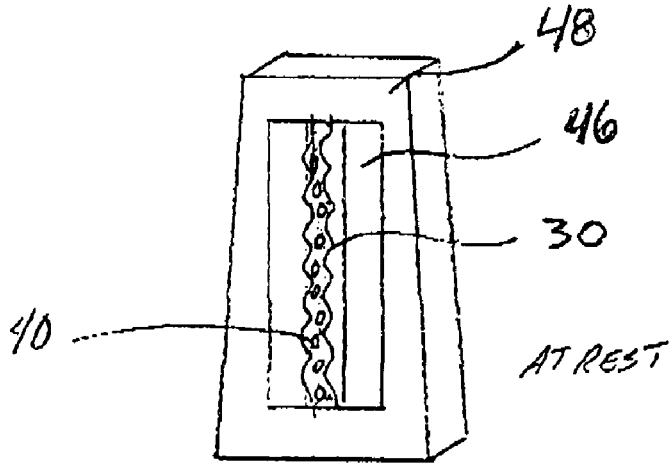
FIG. 10A is a perspective representation of an acoustic ribbon assembly comprising a conductive composite ribbon placed in a magnetic field.

Referring now to FIG. 10A a ribbon element 30 is shown at rest, suspended in a flux frame 48 between magnets 46 and fixed at both ends. As a way to reduce its mass the ribbon element 30 may have perforations 40. The perforating may be done using a laser, a drill, high pressure water machining or a punch, (not shown for clarity of the figures). Once the perforated holes 40 are in place the ribbon element 30 may be coated on both sides with a metallic layer which allows current to flow through the ribbon element by way of the holes 40.

Figure 10B:
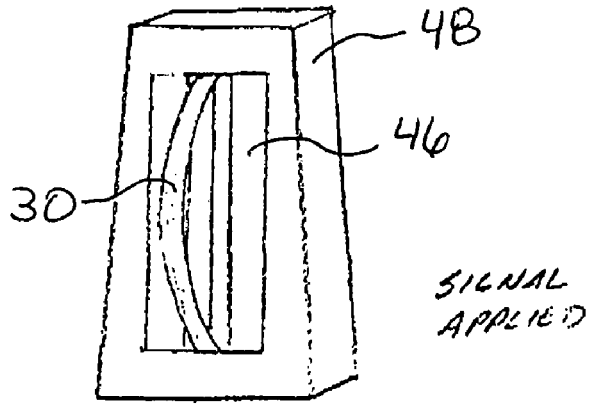
FIG. 10B is a perspective representation of the acoustic ribbon assembly shown in FIG. 10A, being subjected to a signal causing it to extend.
Figure 10C:
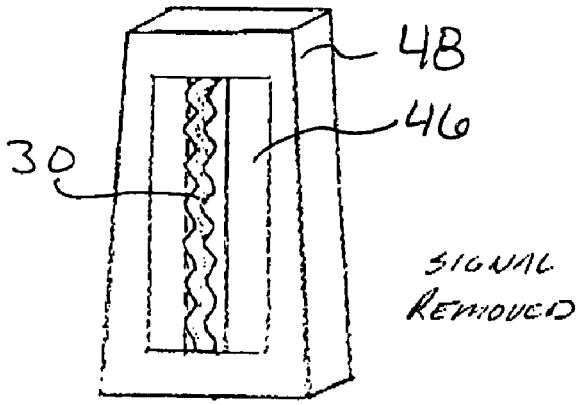
FIG. 10C is a perspective representation of the acoustic ribbon assembly shown in FIG. 10B, with its ribbon returning to its original shape after a signal is removed.

Referring to FIG. 10B shows the ribbon element 30 being elongatively distorted or extended and subsequently returning to its formed geometric shape upon release of any strain thereto, as represented in FIG. 10C.

Figure 11:
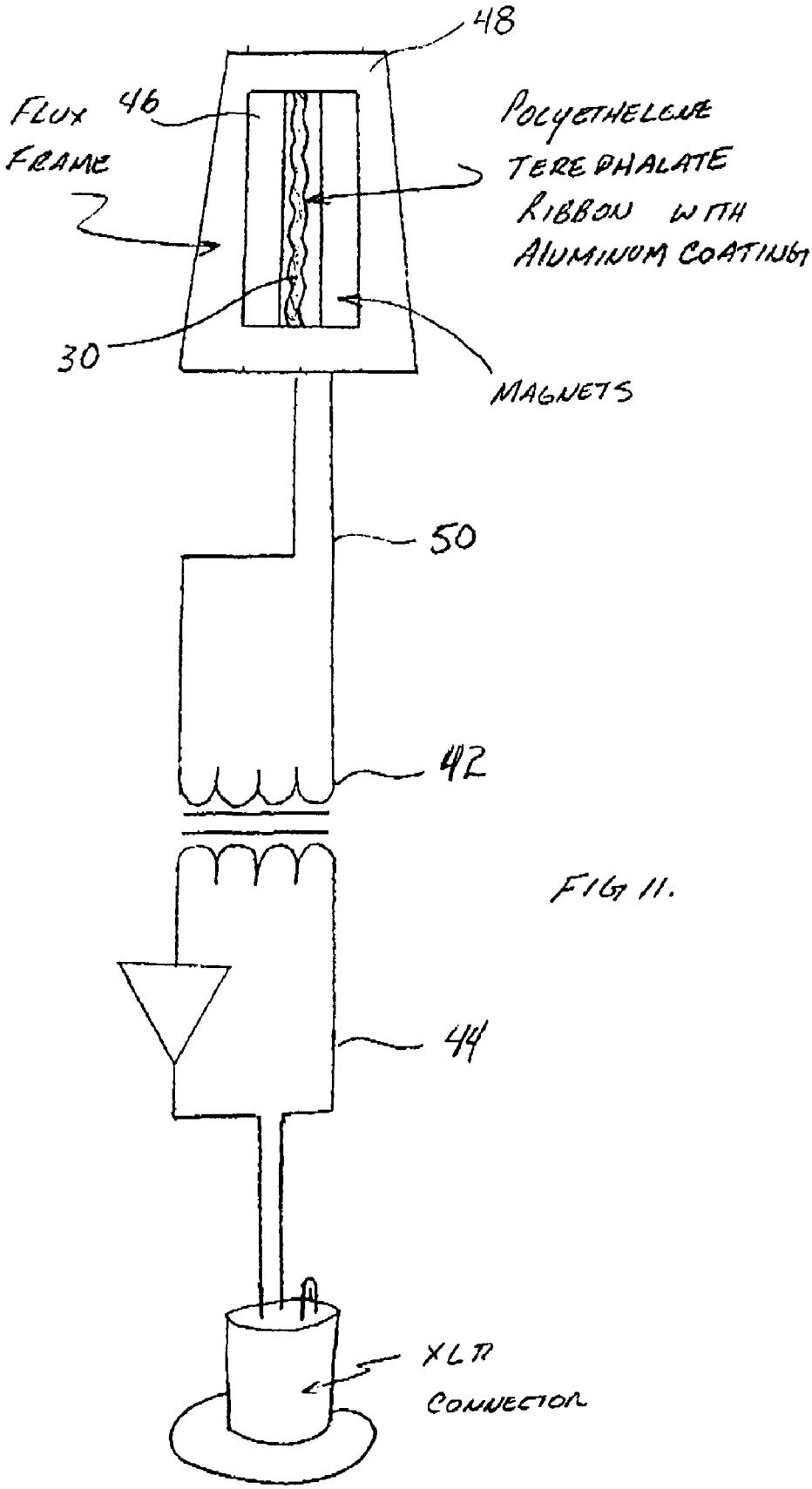
FIG. 11 is a block diagram of the assembly of FIG. 10, wherein a ribbon is connected to a transformer and a further preamplifier.

FIG. 11 is a block diagram representation of the assembly represented in FIG. 10A connected by a proper circuit 50, to a transformer 42 and also to a further preamplifier 44.

Figure 12:
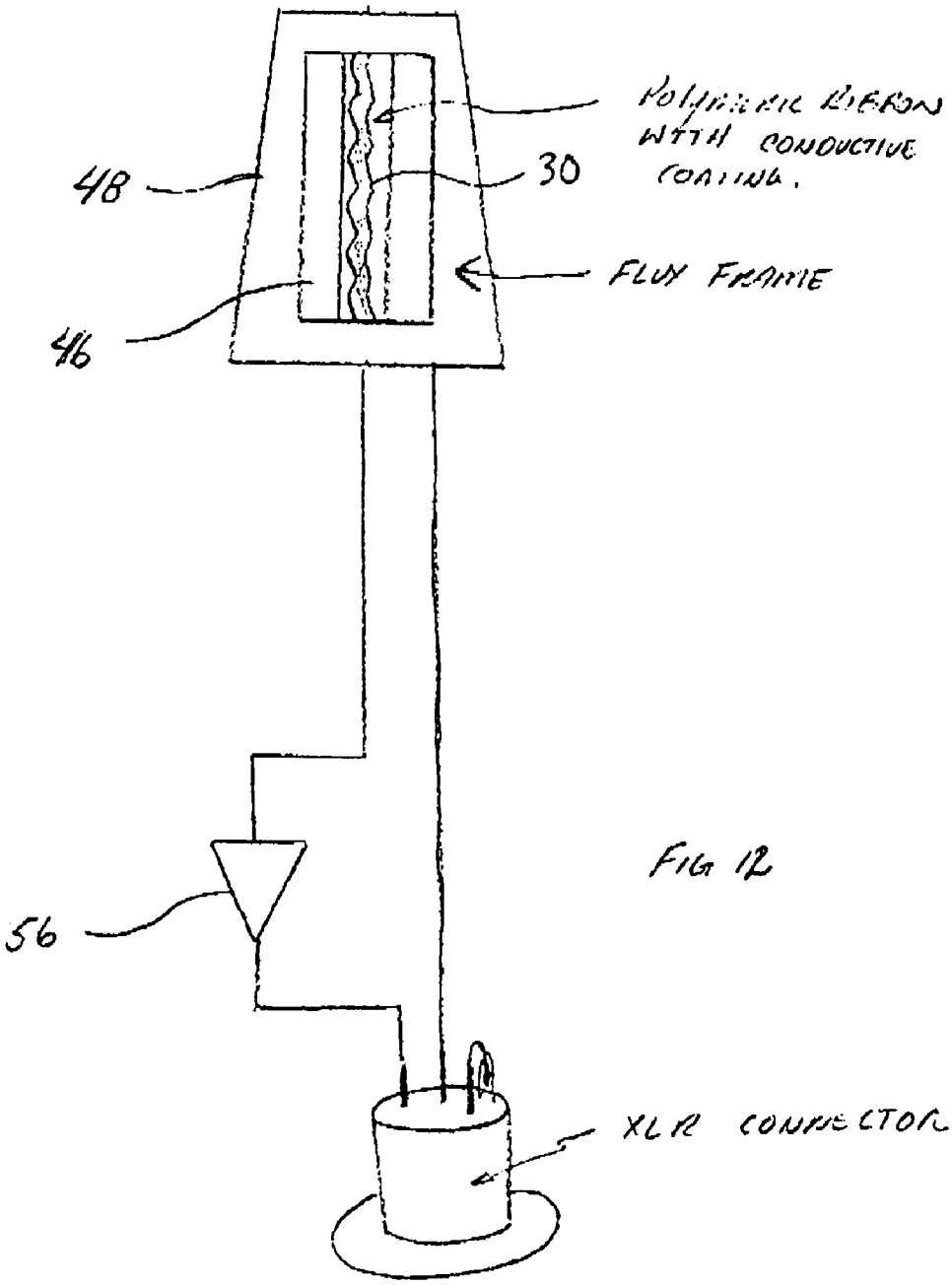
FIG. 12 is a block diagram of the assembly of FIG. 10, wherein the ribbon is directly connected to a device on an amplifier without an intervening transformer.

Referring to FIG. 12 is a block diagram representation of the assembly represented in FIG. 10A, connected directly to an amplifier 56 without an intervening transformer.

Figure 13:
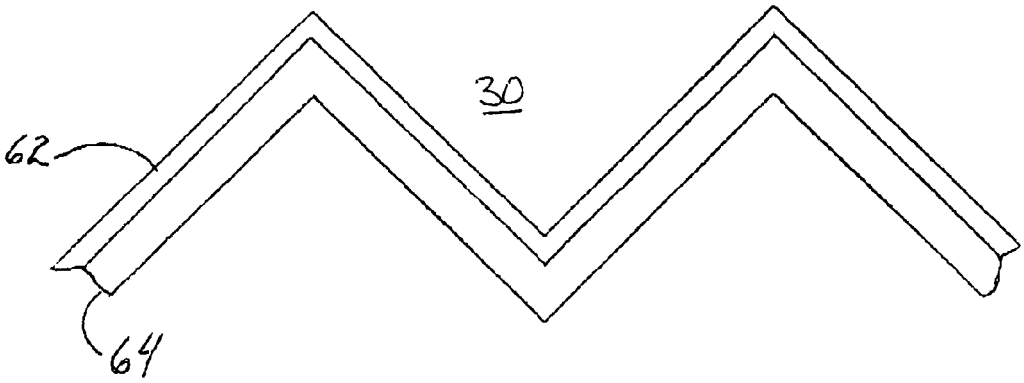
FIG. 13 is an enlarged side view of a corrugated polymer ribbon that is comprised of a shape memory polymer substrate with a conductive layer or coating applied thereon.

Referring now to FIG. 13 is an enlarged side view of a corrugated ribbon element 30 with two layers. One layer is a polymer substrate 64 and the second layer is a conductive coating 62. The conductive coating may be comprised of gold, gold alloys and aluminum as taught herein, or may be comprised of shape memory alloys such as copper/zinc/aluminum, copper/aluminum/nickel, and nickel titanium.

Figure 14:
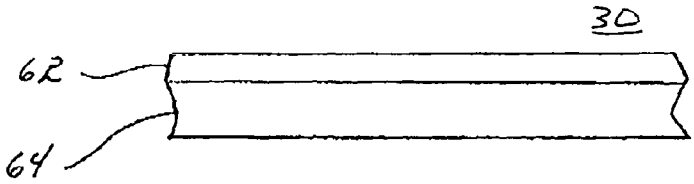
FIG. 14 is an enlarged side view of a polymer substrate with one conductive layer applied to one side thereof.

Referring to FIG. 14 is an enlarged side view of a thin film polymer substrate 64 with a conductive coating 62 before corrugation thereof.

Figure 15:
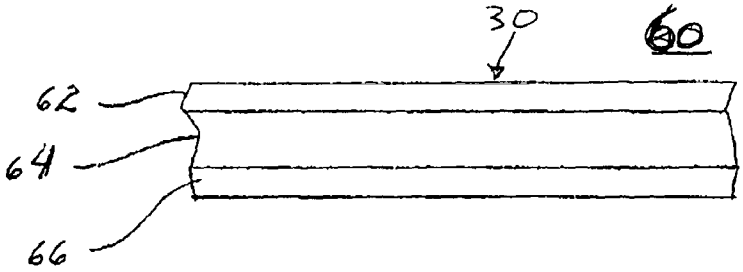
FIG. 15 is an enlarged side view of a polymer substrate sandwiched between two conductive layers.

Referring now to FIG. 15 is an enlarged side view of a thin film polymer substrate 64 with a conductive coating 62 on one side and a conductive coating 66 applied to the opposite side to create a more symmetrical structure with respect to the substrate 64, to improve responsiveness, evenness, and acoustic efficiency of the ribbon assembly 60.

The combination of the polymer substrate 64 and the conductive coating(s) 62 and/or 66 for an acoustic ribbon 60 of the present invention should be limited in weight and/or mass per unit area to that of a single component acoustic aluminum ribbon of the prior art. Such a prior art acoustic aluminum ribbon have dimensions for example, of 3.4"×0.145"×2.5 microns and may weigh 0.002 grams. A strip of thin film polyethylene terephthalate that measures 3.4"×0.145"×2.5 microns weighs about 0.001 grams. This permits 0.001 grams of aluminum metal to be added as a coating to the polymer substrate while maintaining a similar mass compared to prior art ribbons. Thus, a conductive coating (of for example, aluminum of up to 0.001 grams per 3" length) may be added to the polymer substrate as inclusive of the present invention. Such conductive coating (of aluminum) may be added to the substrate 64 in single layers, multiple layers or combinations of thicknesses to one or both sides of that substrate 64.

Referring back to FIG. 13 another method used to produce polymer ribbons is with a polymer substrate that has been pre-coated with a conductive material as taught herein. The conductive coating 62 may be applied using various methods including vacuum vapor deposition. Polyethylene terephthalate 10 is one suitable substrate material but other materials could also be used. Substrate materials may include nylons, polyesters, polyketones and acrylics such as polyaramid, polyurethane, polyimide, polypropylene, PVC, polyethylene, polyester, acetate, polyetheretherketone and other thermoplastic and thermoset polymers. Substrate materials may be configured as flat sheets or as a combination of fibers and or nano-fibers in woven or non-woven states. Materials such as aromatic polyimide, fiber glass, polyester, cotton, expanded PTFE, carbon nanotubes in both sheet and linear form may be used to produce fibers. The fibers may be pre-coated, or coated post processing with a conductive coating or adhered to a sheet of conductive material such as aluminum. Carbon nanotubes may also be attached to a polymer substrate 64 to enhance the electrical conductivity and strength of the applied coating or as the coating itself.

Referring again to FIG. 14 practical ribbon assemblies may be produced using various substrate and coating thickness combinations, including, for example, a 2 micron substrate 64 of polyethylene terephthalate with a 500 nanometer coating of aluminum 62. In sheet form this material will curl tightly when not secured by its edges. The curling may be caused by the differences in mass and shrink rate between the substrate 64 and the coating 62, or by thermal effects which relieve stresses present in the substrate polymer. In order to cut the material into the desired shape for further processing it is desirable for the material to lay reasonably flat. The material may be flattened by placing it between flat 0.015" aluminum plates and heating in an oven. In one practical process embodiment, the oven is preheated to 320° F. and the material placed in the oven for 12 minutes, removed and allowed to cool for 10 minutes.

Referring again to FIG. 15 another method to reduce curling of the material is to apply the conductive coating 62 and 66 to both sides of the substrate 64. The advantage being that a bilateral structure and associated symmetry will exhibit self compensation of lateral forces and therefore may have less curl. Because the substrate material 64 may shrink to a greater degree when a first side is coated, a thicker coating may be applied to the first or second side to balance the curling forces. An alternative to this compensation process may be to deposit conductive layers on all sides of the substrate simultaneously, thereby balancing the resultant stress forces that may distort the underlying substrate and subsequently, the composite structure. A further benefit of dual layer deposition is the potential to use each side as a separate circuit or as separate series or parallel circuit elements that may have the advantage of producing a longer effective path through a magnet gap, and therefore higher sound to current conversion efficiency.

Returning back to FIG. 2 the flattened pre-coated material is sandwiched between two layers of waxed paper 14, and as shown in FIG. 3 cut using a precision shear as taught here within. Once it has been cut the material can be formed between two heated dies as shown in FIG. 7 and also taught here within. The coated substrate material is heated to 300° F. for 12 minutes and allowed to cool for 15 minutes. Other time and temperature combinations may be used to flatten and form the material as long as the material does not become brittle or lose its shape memory.

An advantage of the polyethylene terephthalate film is that it will not become brittle with age under normal conditions because it contains no plasticizers. Another advantage is that it offers good shape retention. Once cooled after the formation of the corrugation of the film, the structure retains its geometry as seen in FIG. 9A, and even when it is deformed for a substantial period of time, represented by FIG. 9B, it will naturally and spontaneously return to the formed geometry when released as seen in FIG. 9C. This ability to remember the formed geometry is called shape memory, and is a desirable property for use in a delicate sound sensitive device such as a microphone, which must remain highly responsive and flexible, yet be rugged and tough enough to withstand high external air pressure forces and internal magnetic and electrical forces.

Referring back to FIG. 10A, the polymer composite ribbon 30, when used in a ribbon microphone, is placed between two strong permanent magnets such as neodymium iron boron 46 with a strong magnetic field and fastened at two ends. The ribbon is free to move between the magnets within a working gap. The polymer composite ribbon 30 is moved by incoming sound pressure as the ribbon 30 moves in the magnetic field and an electronic signal is produced and sent to an amplifier. The polymer ribbon 30 has the ability to pick up sound pressure levels (SPL) in a range as low as 10 db SPL and very loud sound pressure levels as high as 150 db SPL without sound distortion or damage to the ribbon 30 because of the low mass and high strength of the polymer composite and its ability to retain its geometry.

A ribbon microphone built with an aluminum ribbon as described in the prior art can be used in a bidirectional configuration allowing it to receive and process sound levels from multiple directions. It also can be used in a broad frequency range from 30 Hz to 20 KHz. The polymer composite ribbon of the present invention exhibits broad response from 20 Hz to 20 KHz, unlike ribbon tweeters or loudspeakers made from aluminum and or polymers, contrasted graphically in FIGS. 16 and 17, mainly because of the relatively high mass of a ribbon element used in a tweeter or other radiating structure sensitive and small enough to be used as a practical microphone.

Referring back to FIGS. 10A and 10B a polymer composite ribbon 30 may be less susceptible to environmental conditions weakening it such as wind blasts, humidity in the air and moisture. This is because the polymer composite ribbon 30 is less likely to corrode when exposed to moisture, and the process of vapor deposition affords ample opportunity to apply very thin sealing layers, oxide layers etc., which improve environmental durability. The polymer composite ribbon 30 exhibits high strength and has shape memory property enabling it to return to its original geometry when stretched or extended as seen in FIGS. 9A, 9B and 9C. This can be appreciated by comparing a 2 micron polymer ribbon with a 500 nanometer conductive coating of aluminum as seen in FIG. 13 and prepared according to the teachings of this invention, to a conventional aluminum ribbon as used in the prior art, and noting the differences. The process for comparison is as follows: Each ribbon made for the comparison is cut into strips 3.4 inches long by 0.145 inches wide and corrugated. The polymer composite ribbon 30 is corrugated by heat setting as demonstrated in FIGS. 5, 6 and 7 and taught herein, and the conventional aluminum ribbon is corrugated using mechanical distortion means. Mechanical distortion, or bending, can be produced by passing the thin conventional ribbon material through a set of enmeshed gears as is commonly encountered in the prior art. The corrugated ribbons thus produced have a reduced overall corrugated lengths of 2.480 inches for the conventional aluminum ribbon used in the prior art, and 2.906 inches for the polymer ribbon 30.

Once prepared, each ribbon is extended under moderate tension in the axial direction as demonstrated in FIG. 9B until the corrugations may be observed to be flat or as nearly so as practical. Once extended and flattened, each ribbon is then released and allowed to relax, and the result observed and measured. It can be observed that the conventional aluminum ribbon, when extended so that the corrugations became flat or as nearly so as practical, and it is allowed to relax was 0.73 inches longer than the original corrugated length. Therefore the total resting elongation of the aluminum ribbon after extension and relaxation is 23%. Such an elongated ribbon is not suitable for use in a ribbon microphone.

By contrast, the polymer composite ribbon 30 when also extended so that the corrugations become flat or nearly so can be observed to return to its original length when released, as demonstrated in FIGS. 9A, 9B and 9C. The relaxed length after extension is 2.906 inches or 0.00 inches longer than the original corrugated length. Therefore the total resting elongation of the polymer ribbon after extension and relaxation is negligible. This ability of a thin, light, low mass, highly conductive, air responsive ribbon like structure to return to shape after extension is highly desirable and is a significant improvement over the prior art. This toughness is the result of a system that has adequate elasticity and strength to maintain shape memory under similar stretching and/or extension as commonly encountered in sound sensing applications yet retains high conductivity needed for effective transducer efficiency.

The process of forming a conductive, shape memory ribbon 30 may also be performed in reverse, by providing a conductive substrate first such as an aluminum ribbon used in ribbon microphones, and then depositing a settable polymer onto the conductive substrate through vapor deposition. Such polymeric vapor deposition may be performed in a controlled chamber with heat, gases, ultraviolet curing lamps and polymer vaporization capabilities which may include plastic films such as thermoplastics like PET, PEEK, Kapton or Parylene, or carbon deposition of nanotubes and films. The polymeric vapor may be effective to conform to a preformed ribbon, further aiding the shape retention qualities, and may be enhanced by the application of fibrous substances, particles, and at various thicknesses at different locations. Alternatives also include lamination processes or any process of providing combined physical properties, with the object to provide the elongation and toughness characteristics, while maintaining low mass and high conductivity, all required to produce a successful sound sensor ribbon microphone arrangement which is one object of the present invention.

The invention claimed is:

1. An elongated acoustic ribbon for a transducer comprising:

multiple layers of material, wherein at least one of the multiple layers is comprised of a conductive material and at least one of the multiple layers is formed of a nonconductive material; and wherein said ribbon is cyclable from a corrugated form having a length to an elongatively distorted non-corrugated form and back to the original corrugated form and length.

2. The ribbon as recited in claim 1, wherein said conductive material is comprised of aluminum.

3. The ribbon as recited in claim 1, wherein said nonconductive material is comprised of a polymer.

4. The ribbon as recited in claim 1, wherein said nonconductive material has a thickness of about 3 microns or less and said conductive layer has a thickness of at least 100 nanometers, with a total weight of about 0.004 grams per square inch or less and a sound responsive component having an acoustic responsivity of about 20 Hz to about 20 KHz.

5. The ribbon as recited in claim 1 wherein at least one of said layers is comprised of a highly elastic shape memory material.

6. An acoustic ribbon for use in a flux frame of an acoustic ribbon microphone, comprising:

an elongated polymeric substrate having a conductive coating;

an arrangement of holes spaced along said substrate through said conductive coating and said substrate; and wherein said ribbon is cyclable from a corrugated form having a length to an elongatively distorted non-corrugated form and back to the original corrugated form and length.

7. The acoustic ribbon as recited in claim 6, wherein said conductive coating is comprised of nickel titanium.

8. The acoustic ribbon as recited in claim 6, wherein said conductive coating is comprised of a compound selected from the group consisting of gold, aluminum, copper, zinc, nickel, and combinations thereof.

9. The acoustic ribbon as recited in claim 6, wherein said elongated polymeric substrate is comprised of a zig-zag geometric shape.

10. An elongated acoustic ribbon for microphones, said ribbon being comprised of a polymer substrate and a first conductive layer of metal coated on a first side of said substrate, said acoustic ribbon having a total weight per unit area of no greater than approximately 0.004 grams per square inch, and wherein said ribbon is cyclable from a corrugated form having a length to an elongatively distorted non-corrugated form and back to the original corrugated form and length.

11. The elongated acoustic ribbon as recited in claim 10, wherein said substrate comprises polyethylene terephthalate.

12. The elongated acoustic ribbon as recited in claim 10, wherein said substrate is coated by a second conductive layer of metal on a second side thereof.

13. The elongated acoustic ribbon as recited in claim 10, wherein the ribbon resides unstrained in a zig-zag shape in cross section.

14. The elongated acoustic ribbon as recited in claim 13, wherein the ribbon is cyclable from the zig-zag shape to a flat form and back to the zig-zag shape.

15. The elongated acoustic ribbon as recited in claim 12, wherein said second conductive layer of metal is comprised of metal of a different thickness than said first conductive layer.

16. The elongated acoustic ribbon, as recited in claim 12, wherein said second conductive layer of metal is comprised of a different conductive metal than said first conductive layer.

17. An elongated acoustic microphone ribbon element assembly, comprising:

an elongated shape memory polymeric substrate; and a conductive metal coating arranged on both a first and a second side of said substrate, wherein said ribbon element assembly weighs no more than 0.004 grams per square inch;

wherein said substrate has a predetermined zig-zag shape formed thereon; and wherein said ribbon element is cyclable from the zig-zag shape to an elongatively distorted non-zig-zag shape and back to the original zig-zag shape and length.

18. The elongated acoustic microphone ribbon element assembly as recited in claim 17, wherein said conductive coating comprises carbon nanotubes.

19. The elongated acoustic microphone ribbon element assembly as recited in claim 17, wherein said substrate comprises polyethylene terephthalate.

20. The elongated acoustic microphone ribbon element assembly as recited in claim 17, wherein said coating comprises a metal.

21. The elongated acoustic microphone ribbon element assembly as recited in claim 17, wherein said coating is selected from the group consisting of aluminum, gold, silver, nitinol, copper-zinc-aluminum and copper-aluminum-nickel.

22. The elongated acoustic microphone ribbon element assembly as recited in claim 17, wherein said assembly has dimensions of about: length 3.4" and 0.145" wide and 2.5 microns thick, and weighs about 0.002 grams.

23. The elongated acoustic microphone ribbon element assembly as recited in claim 17, wherein said substrate is perforated.

24. The elongated acoustic microphone ribbon element assembly as recited in claim 17, wherein said coating is perforated.

25. An elongated acoustic ribbon for a transducer comprising:

a first layer and second layer wherein the first layer and the second layer comprise a nonconductive material and a conductive material; and wherein the first layer and the second layer together have a formed geometry having a length and wherein the first layer and the second layer provide a shape memory property enabling the ribbon to stretch to an elongatively distorted non-formed shape and to return to the original formed geometry and length.

26. The ribbon as recited in claim 25, wherein the conductive material is comprised of one of aluminum, gold, silver, nitinol, copper-zinc-aluminum, copper-aluminum-nickel, and carbon nanotubes.

27. The ribbon as recited in claim 25, wherein the nonconductive material is comprised of a polymeric film.

28. The ribbon as recited in claim 27, wherein the polymeric film comprises polyethylene terephthalate.

29. The ribbon as recited in claim 25, wherein the ribbon has a mass per unit area of about 0.004 grams per square inch or less.

30. The ribbon as recited in claim 25, wherein the conductive material is comprised of a highly elastic shape memory material.

31. The ribbon as recited in claim 25, wherein the first layer comprises a conductive layer and forms a coating on a first side of the second layer and a third layer of conductive coating is placed on a second side of the second layer.

32. The ribbon as recited in claim 25, wherein the formed geometry of the ribbon forms a zig-zag shape.

33. The ribbon as recited in claim 25, wherein the ribbon has an acoustic responsivity of about 20 Hz to about 20 KHz.

34. The ribbon as recited in claim 1, wherein the elongatively distorted non-corrugated form has a degree of curvature.

35. The acoustic ribbon as recited in claim 6, wherein the elongatively distorted non-corrugated form has a degree of curvature.

36. The elongated acoustic ribbon as recited in claim 10, wherein the elongatively distorted non-corrugated form has a degree of curvature.

37. The elongated acoustic microphone ribbon element assembly as recited in claim 17, wherein the elongatively distorted non-zig-zag shape has a degree of curvature.

38. The ribbon as recited in claim 25, wherein the elongatively distorted non-formed shape has a degree of curvature.

* * * * *